United States Patent [19]

Chen et al.

[11] Patent Number: 4,944,862

[45] Date of Patent: Jul. 31, 1990

[54] INTEGRATED CATALYTIC DEWAXING AND CATALYTIC CRACKING PROCESS

[75] Inventors: Nai Y. Chen, Titusville; Anil B. Ketkar, Cranbury; Randall D. Partridge, West Trenton, all of N.J.

[73] Assignee: Mobil Oil Corporation, New York, N.Y.

[21] Appl. No.: 262,779

[22] Filed: Oct. 26, 1988

[51] Int. Cl.[5] ..... C10G 69/04; C10G 55/06

[52] U.S. Cl. ..... 208/49; 208/58; 208/74; 208/91; 585/739

[58] Field of Search ..... 208/85, 91, 74, 67, 208/49, 58, 46; 585/736, 737, 739

[56] References Cited

U.S. PATENT DOCUMENTS

| | | | |
|---|---|---|---|
| 3,098,029 | 7/1959 | Snyder, Jr. | 208/61 |
| 3,135,682 | 6/1964 | Mason et al. | 208/68 |
| 3,684,691 | 8/1972 | Arey et al. | 208/102 |
| 3,689,402 | 9/1972 | Youngblood et al. | 208/113 |
| 3,891,540 | 6/1975 | Demmel et al. | 208/68 |
| 4,332,670 | 1/1982 | Antal | 208/120 |
| 4,370,219 | 1/1983 | Miller | 208/59 |
| 4,388,176 | 6/1983 | Pratt et al. | 208/80 |
| 4,419,220 | 12/1983 | La Pierre et al. | 208/111 |
| 4,428,819 | 1/1984 | Shu et al. | 208/49 |
| 4,428,826 | 1/1984 | Walsh | 208/120 |
| 4,446,008 | 5/1984 | Smith | 208/111 |
| 4,501,926 | 2/1985 | LaPierre et al. | 585/739 |
| 4,554,065 | 11/1985 | Albinson et al. | 208/59 |
| 4,784,749 | 11/1988 | Chang et al. | 208/120 |
| 4,788,378 | 11/1988 | Chang et al. | 585/739 |
| 4,834,867 | 5/1989 | Gilson | 208/120 |
| 4,877,581 | 10/1989 | Chen et al. | 585/739 |

*Primary Examiner*—Anthony McFarlane

*Attorney, Agent, or Firm*—A. J. McKillop; C. J. Speciale; R. D. Stone

[57] ABSTRACT

Dewaxing, preferably catalytic dewaxing over zeolite beta or ZSM-5, improves the crackability of a heavy, waxy feed to a catalytic cracking unit. When the catalytic dewaxing occurs at temperatures above about 360° C., using ZSM-5 dewaxing catalyst, high octane gasoline is obtained as a by product of catalytic dewaxing.

22 Claims, 2 Drawing Sheets

INTEGRATED CATALYTIC DEWAXING AND CATALYTIC CRACKING PROCESS

FIELD OF THE INVENTION

This invention relates to catalytic dewaxing integrated with catalytic cracking to upgrade of heavy hydrocarbon oils.

BACKGROUND OF THE INVENTION

The present invention combines two known processes, catalytic dewaxing and catalytic cracking, to obtain a very satisfactory heavy hydrocarbon upgrading process. To aid in understanding the present invention, both dewaxing and catalytic cracking will be discussed in some detail hereafter.

CATALYTIC DEWAXING

Processes for dewaxing petroleum distillates have been known for a long time. As used herein, dewaxing means removal of at least some of the normal paraffin content of the feed. The removal may be accomplished by isomerization of n-paraffins or cracking. Dewaxing is, as is well known, required when highly paraffinic oils are to be used in products which need to remain mobile at low temperatures e.g., lubricating oils, heating oils, jet fuels. The higher molecular weight straight chain normal and slightly branched paraffins which are present in oils of this kind are waxes which are the cause of high pour points in the oils and if adequately low pour points are to be obtained, these waxes must be wholly or partly removed or converted. In the past, various solvent removal techniques were used e.g., MEK dewaxing, but the decrease in demand for petroleum waxes as such, together with the increased demand for gasoline and distillate fuels, has made it desirable to find processes which not only remove the waxy components but which also convert these components into other materials of higher value. Catalytic dewaxing processes achieve this end by selectively cracking the longer chain n-paraffins, to produce lower molecular weight products which may be removed by distillation. Processes of this kind are described, for example, in The Oil and Gas Journal, Jan. 6, 1975, pages 69 to 73 and U.S. Pat. No. 3,668,113.

In order to obtain the desired selectivity, the catalyst has usually been a zeolite having a pore size which admits the straight chain n-paraffins either alone or with only slightly branched chain paraffins, but which excludes more highly branched materials, cycloaliphatics and aromatics. Zeolites such as ZSM-5, ZSM-11, ZSM-12, ZSM-23, ZSM-35 and ZSM-38 have been proposed for this purpose in dewaxing processes and their use is described in U.S. Pat. Nos. 3,894,938; 4,176,050; 4,181,598; 4,222,855; 4,229,282 and 4,247,388. A dewaxing process employing synthetic offretite is described in U.S. Pat. No. 4,259,174. A hydrocracking process employing zeolite beta as the acidic component is described in U.S. Pat. No. 3,923,641.

An improved dewaxing process is disclosed in U.S. Pat. No. 4,419,220, the entire contents of which is incorporated herein by reference. This patent discloses that hydrocarbons such as distillate fuel oils and gas oils may be dewaxed primarily by isomerization of the waxy components over a zeolite beta catalyst. The process may be carried out in the presence or absence of added hydrogen, although operation with hydrogen is preferred.

This patent showed that isomerization dewaxing of waxy feedstocks could be achieved. Numerous examples were included, showing that the process was applicable to feedstocks ranging from light gas oils, both raw and hydrotreated, vacuum gas oils, to distillate fuel oils obtained by Thermofor catalytic cracking.

Although catalytic dewaxing (whether shape selective dewaxing or isomerization dewaxing) is an effective process, it has some limitations. Catalytic dewaxing process remove wax, but do not change the end point of the product to a great extinct. The problem is most severe when using a shape selective zeolite catalyst such as ZSM-5, which selectively cracks the normal and slightly branch chain paraffins, but leaves most other components untouched. This has constrained somewhat the feeds to most shape selective catalytic dewaxing processes, in that the end point of the product usually sets the end point of feed. This was a hindrance, as the catalytic dewaxing process could tolerate heavier feeds, and even be looked on as source of relatively high octane gasoline-by-product, by using the hydrodewaxing method disclosed in U.S. Pat. No. 4,446,007 Smith, which is incorporated herein by reference. Increasing the hydrodewaxing temperature to at least 360° C. within about seven days of start-up produces high octane gasoline (as a by-product from the cracking of normal paraffins). This approach improved the economics of the dewaxing process by making the light by-products (the gasoline fraction) more valuable, but did not address the end-point problem.

Refiners could have charged feeds including unacceptably high end-point materials to a catalytic dewaxing unit, and then further fractionated the heavy fuel oil product of dewaxing to meet end-point specifications. So far as is known, this has not been done, probably because the extra cost associated with the processing of a slightly heavier feed, and of further fractionating the heavy ends out of the dewaxed product, were not cost effective.

Accordingly, no way was available to take full advantage of the potential of catalytic dewaxing to dewax, produce high octane gasoline, and achieve some conversion in boiling with high end point stocks.

FLUIDIZED CATALYTIC CRACKING

This is a very common process, and a detailed description thereof is not believed necessary. Somewhat oversimplified, catalyst contacts heavy hydrocarbon oil in a fluidized bed or riser reactor, cracking the oil and coking the catalyst. Coke is burned from the catalyst in a fluidized bed regeneration zone to regenerate the catalyst, with regenerated catalyst being recycled to react further with hydrocarbon feed.

More details of the fluidized catalytic cracking process are disclosed in U.S. Pat. Nos. 4,309,279 and 4,309,280, the entire contents of which are incorporated herein by reference.

MOVING BED CATALYTIC CRACKING

This process was introduced in the early 1940's and a detailed description thereof is not believed necessary.

Briefly, the process uses a moving bed of catalytic cracking catalyst. Catalyst moves from the catalytic cracking reactor to a moving bed regenerator, and from there back to the reactor.

The oil chargestock to the process, usually without added hydrogen, is passed over the moving bed of catalyst and is catalytically cracked to lighter products. During catalytic cracking, the catalyst is deactivated by coke deposition. Coke deposition is removed from the catalyst in a moving bed regenerator associated with the moving bed cracking unit.

The products produced by moving bed cracking are very similar to those produced by the FCC process.

Although catalytic cracking (whether moving bed or fluid bed) is a highly efficient way of obtaining lighter products from heavier crudes, some problems remain. Modern catalytic cracking catalysts use relatively large pore zeolites, such as X, Y, RE-USY, etc. to do most of the cracking. These zeolites tend to be aromatic selective, and are not very efficient at converting normal paraffins. This has several adverse consequences. The most significant is that the heavy fuel oil product may have a pour point higher than desired, especially when processing relatively waxy feeds. Although catalytic cracking changes boiling range, it does not dewax. If the feed boiling in the heavy fuel oil range, typically about 650° to 1000° F. has an unacceptable pour point before cracking, the product of catalytic cracking boiling in the same boiling range will have about the same pour point, or perhaps a slightly higher pour point. The high pour points are attributable to normal paraffins that survive catalytic cracking, and to some extent because of long alkyl chains on aromatic hydrocarbons. These high pour points significantly reduce the value of the heavy fuel oil product.

A closely related problem is the poor crackability of waxy feeds. Catalytic cracking efficiently converts naphthenes, most aromatic species, and highly branched paraffins to lighter materials, but is much less efficient at cracking of normal paraffins and slightly branched paraffins. The presence of large amounts of waxy materials in the FCC feeds means that the catalytic cracking unit has to work significantly harder to achieve the same overall conversion. Refiners have recognized that highly paraffinic feeds are harder to crack, and many refiners have generated mathematical models which predict accurately the yields that can be obtained by catalytic cracking of any feed, including those containing large amounts of wax. So far as is known, refiners have not tried to improve the crackability of waxy feeds to an FCC by first removing the waxy components from the feed.

A few refiners have improved the crackability of feeds by hydrotreating the feed, or hydrotreating a recycle stream, e.g., a highly aromatic heavy cycle oil. Hydrotreating converts highly condensed aromatic structures into naphthenes which are more readily crackable in the FCC unit.

We discovered that catalytic dewaxing could do more than merely upgrade a heavy fuel oil product from an FCC or TCC unit. We found that the product of an isomerization dewaxing process or shape selective wax cracking process was rendered uniquely susceptible to further upgrading in the FCC or TCC unit. We discovered that overall operation of an FCC unit could be significantly enhanced both in terms of gasoline plus distillate yield, and in terms of product pour point, by subjecting the FCC feed or a recycle stream to catalytic dewaxing.

BRIEF SUMMARY OF THE INVENTION

Accordingly, the present invention provides a process for upgrading a heavy hydrocarbon liquid feed comprising waxy components, and relatively high boiling components comprising subjecting at least a portion of said feed to dewaxing to produce a dewaxed product with a reduced wax content; and contacting at least a portion of said dewaxed product with a conventional catalytic cracking catalyst in a conventional catalytic cracking unit to produce a catalytically cracked product with a reduced boiling point relative to said dewaxed product.

In another embodiment the present invention provides a process for upgrading a heavy waxy feed comprising normal and slightly branched chain paraffins and wherein at least 75 percent of said feed boils at a temperature in excess of 650° F. comprising subjecting said heavy fraction to catalytic dewaxing over catalyst comprising zeolite beta having a silica to alumina mole ratio in excess of 10:1 and comprising a hydrogenation/-dehydrogenation component, in a reaction zone maintained under reaction conditions including a temperature of 200° to 540° C., a pressure of atmospheric to 25,000 kPa, a space velocity of 0.1 to 20 $hr^{-1}$ and in the presence of hydrogen in an amount equal to about 75 to 4000 normal liters per liter to produce a heavy dewaxed product with reduced wax content; and subjecting at least a portion of said heavy dewaxed product to conventional catalytic cracking at conventional catalytic cracking conditions to produce a catalytically cracked product with a reduced boiling point relative to said heavy dewaxed product fed to said catalytic cracking unit.

In yet another embodiment the present invention provides a process for upgrading a heavy waxy feed comprising normal and slightly branched chain paraffins and wherein at least 75 percent of said feed boils at a temperature in excess of 650° F. comprising: subjecting said feed to isomerization dewaxing over catalyst comprising zeolite beta having a structural silica to alumina mole ratio in excess of 30:1 and comprising a hydrogenation/dehydrogenation component, in a reaction zone maintained under reaction conditions including a temperature of 200° to 540° C., a pressure of atmospheric to 25,000 kPa, a space velocity of 0.1 to 20 $hr^{-1}$ and in the presence of hydrogen in an amount equal to about 75 to 4000 normal liters per liter to produce a heavy product with reduced wax content and containing a significant amount of isoparaffins as a result of said isomerization; charging at least a majority of said isoparaffins to a catalytic cracking unit containing a catalyst comprising a large pore zeolite in an amorphous matrix to catalytically crack a majority of said isoparaffins to lighter boiling components.

DETAILED DESCRIPTION

FEEDSTOCK

Figure 1:
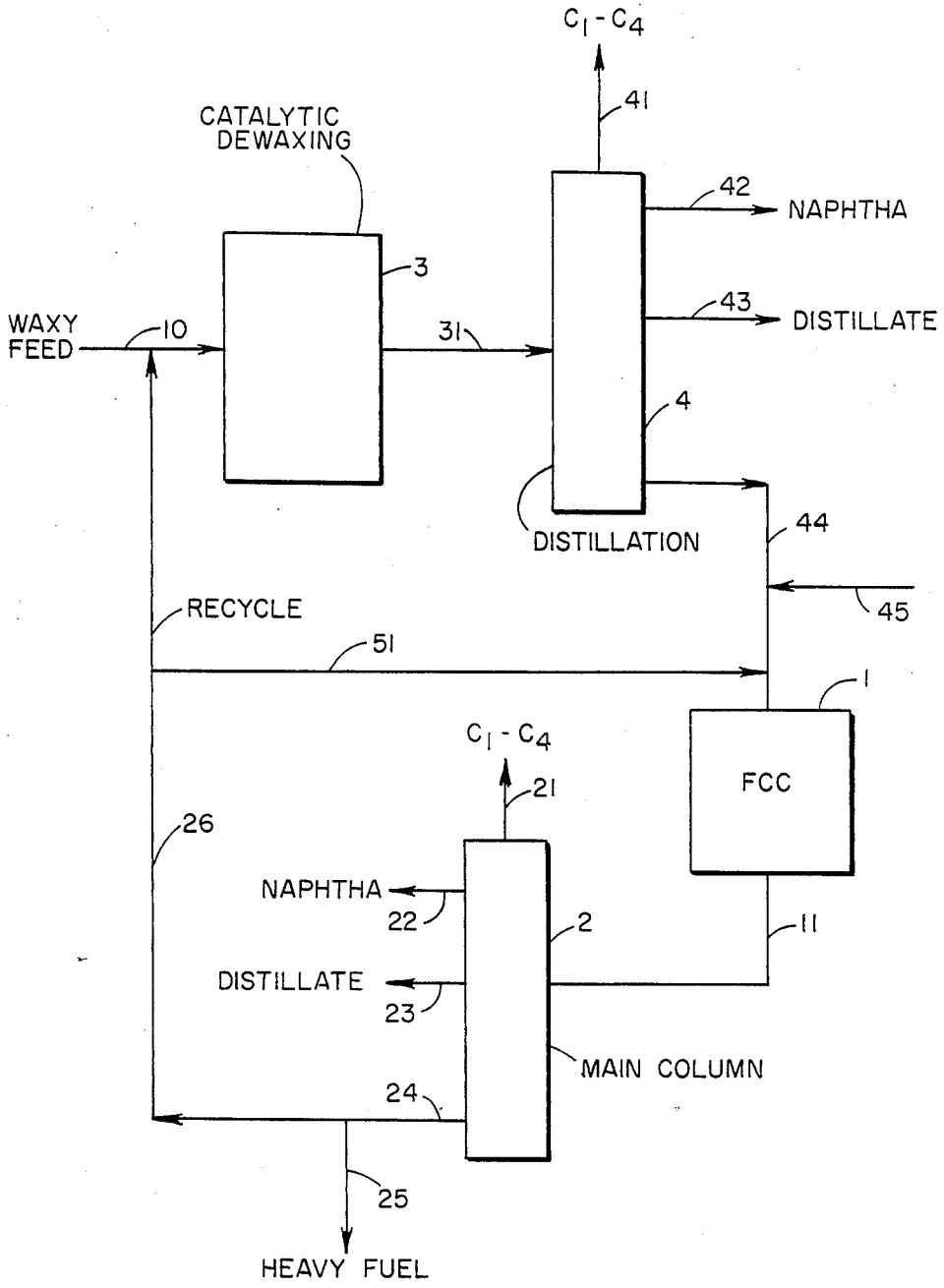
FIG. 1 is a simplified diagram of an FCC unit operating in conjunction with a catalytic dewaxing unit.

The present process may be used to dewax a variety of feedstocks ranging from relatively light distillate fractions up to high boiling stocks such as whole crude petroleum, reduced crudes, vacuum tower residua, cycle oils, gas oils, vacuum gas oils, deasphalted residua and other heavy oils. The feedstock will normally be a $C_{10}$+feedstock since lighter oils will usually be free of significant quantities of waxy components. However, the process is particularly useful with waxy distillate stocks to produce gas oils, kerosenes, jet fuels, lubricating oil stocks, heating oils and other distillate fractions whose pour point and viscosity need to be maintained within certain specification limits. Lubricating oil stocks will generally boil above 230° C. (450° F.), more usually above 315° C. (600° F.). Hydrocracked stocks are a convenient source of stocks of this kind and also of other distillate fractions since they normally contain significant amounts of waxy n-paraffins which have been produced by the removal of polycyclic aromatics. The feedstock for the present process will normally be a $C_{10}$+feedstock containing paraffins, olefins, naphthenes, aromatics and herterocyclic compounds and with a substantial proportion of higher molecular weight n-paraffins and slightly branched paraffins which contribute to the waxy nature of the feedstock.

Typical feedstocks include light gas oils, heavy gas oils and reduced crudes boiling above 150° C.

Preferably the feed has a relatively low asphaltene content. As measured by Conradson Carbon Residue, CCR, the feed should have a CCR content less than 8 wt %, and preferably less than 5 wt %. Most feeds will have no more than 1 or 2 wt % CCR. This low asphaltenic level may be achieved by deasphalting the feed.

The waxy feeds which are most benefited by the practice of the present invention will have relatively high pour points, usually above 100° F., but feeds with pour points ranging from 50° to 150° F. may be used.

The end point of the feed to the catalytic dewaxing reactor is not limited to the end point of the heavy fuel oil product. The feed may include as much of the "bottom of the barrel" or residual fraction of the crude as the catalytic dewaxing unit can tolerate. Some of the residual fraction can be converted directly to high octane gasoline as a by-product, provided the dewaxing process is operted as specified in U.S. Pat. No. 4,446,007.

RECYCLE STREAM AS FEED

It is also possible, and preferred in some circumstances, to recycle a heavy fraction of the FCC product to the catalytic dewaxing unit. When dewaxing capacity is limited, it may be beneficial to dewax only relatively heavy recycle streams and send these to these dewaxed streams to the catalytic cracking unit.

CATALYTIC CRACKING

The FCC and TCC processes are well known, and were described in the Background Section, so further discussion is not needed of these processes.

CONVENTIONAL CRACKING CATALYST

The cracking catalyst can be any conventional cracking catalyst now used or hereafter developed. Relatively large pore zeolites in clay or other matrix material are preferred. It is also possible, and acceptable, to use ultrastable Y, ultrahydrophobic Y, and other conventional large pore catalytic cracking materials.

Pillared interlayered clays, such as those used in U.S. Pat. No. 4,742,033 incorporated herein by reference, may be used as part or all of the cracking component.

Preferred cracking catalysts contain 1 to 40 weight percent large pore zeolite material, preferably a low sodium, rare earth exchanged Y-type zeolite. Very good results are obtained when the catalyst has 5–25 weight percent REY or RE-USY zeolite in the matrix.

Amorphous cracking catalysts, or mixtures of conventional catalyst with shape selective zeolites such as ZSM-5 may be used.

ZEOLITE BETA DEWAXING

Details of the isomerization or catalytic dewaxing process are disclosed in U.S. Pat. No. 4,419,220, the entire contents of which have been incorporated herein by reference.

The feedstock to the dewaxing process will be the relatively heavy feedstock previously discussed.

Although isomerization dewaxing is preferred to maximize liquid yields, a significant amount of hydrocracking is acceptable, and may be preferred when maximum conversion of feed to lighter materials is desired. Higher temperatures, lower silica alumina ratios, higher hydrogen partial pressures all favor hydrocracking. Wax hydrocracking with zeolite beta is also a known process described in U.S. Ser. No. 379,421, which is incorporated herein by reference.

ZEOLITE BETA DEWAXING CATALYST

The catalyst used in the process comprises zeolite beta, preferably with a hydrogenating component. Zeolite beta is a known zeolite which is described in U.S. Pat. Nos. 3,308,069 and Re 28,341, to which reference is made for further details of this zeolite, its preparation and properties. The composition of zeolite beta in its as synthesized form is as follows on an anhydrous basis:

$$[XNa(1.0\pm0.1-X)TEA]A10_2\times YSiO_2.$$

where X is less than 1, preferably less than 0.75; TEA represents the tetraethylammonium ion; Y is greater than 5 but less than 100. In the as-synthesized form, water of hydration may also be present in ranging amounts.

Other details regards the manufacture and characterization of zeolites can be found in U.S. Pat. No. 4,419,220, which has been incorporated herein by reference.

The zeolite is preferably associated with a hydrogenation-dehydrogenation component, regardless of whether hydrogen is added during the process. The hydrogenation component is preferably a noble metal such as platinum, palladium, or another member of the platinum group such as rhodium. Combinations of noble metals such as platinum-rhenium, platinum-palladium, platinum-iridium or platinum-iridium-rhenium together with combinations with non-noble metals, particularly of Groups VIA and VIIIA are of interest, particularly with metals such as cobalt, nickel, vanadium, tungsten, titanium and molybdenum, for example, platinum-tungsten, platinum-nickel or platinum-nickel-tungsten.

The metal may be incorporated into the catalyst by any suitable method such as impregnation or exchange onto the zeolite. The metal may be incorporated in the form of a cationic, anionic or neutral complex such as $Pt(NH_3)_4^{2+}$ and cationic complexes of this type will be found convenient for exchanging metals onto the zeolite. Anionic complexes such as the vanadate or metatungstate ions are useful for impregnating metals.

The amount of the hydrogenation-dehydrogenation component is suitably from 0.01 to 10 percent by weight, normally 0.1 to 5 percent by weight, although this will, of course, vary with the nature of the component, less of the highly active noble metals, particularly platinum, being required than of the less active base metals.

Base metal hydrogenation components such as cobalt, nickel, molybdenum and tungsten or combinations thereof may be subjected to a pre-sulfiding treatment with a sulfur-containing gas such as hydrogen sulfide in order to convert the oxide forms of the metal to the corresponding sulfides. Base metal hydrogenation components may be preferred when significant hydrocracking is desired.

It may be desirable to incorporate the catalyst in another material resistant to the temperature and other conditions employed in the process. Such matrix materials include synthetic or natural substances as well as inorganic materials such as clay, silica and/or metal oxides. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calcination, acid treatment or chemical modification.

The catalyst may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia-zirconia. The matrix may be in the form of a cogel with the zeolite. The relative proportions of zeolite component and inorganic oxide gel matrix may vary widely with the zeolite content ranging from between 1 to 99, more usually 5 to 80, percent by weight of the composite. The matrix may itself possess catalytic properties, generally of an acidic nature.

ISOMERIZATION DEWAXING PROCESS CONDITIONS

The feedstock is contacted with the zeolite in the presence or absence of added hydrogen at elevated temperature and pressure. The isomerization is preferably conducted in the presence of hydrogen both to reduce catalyst aging and to promote the steps in the isomerization reaction which are though to proceed from unsaturated intermediates. Temperatures are normally from 250° C. to 500° C. (about 480° F. to 930° F.), preferably 300° C. to 450° C. (about 570° to 840° F.) but temperatures as low as 200° C. (392° F.) may be used for highly paraffinic feedstocks, especially pure paraffins. The use of lower temperatures tends to favor the isomerization reactions over the cracking reactions and therefore the lower temperatures are preferred. Pressures range from atmospheric up to 25,000 kPa (3,600 psig). Practical considerations generally limit the pressure to a maximum of 15,000 kPa (2,160 psig), more usually in the range of 1,500 to 10,000 kPa (about 200 to 1,435 psig). Space velocity (LHSV) is generally from 0.1 to 10 $hr^{-1}$ more usually 0.2 to 5 $hr^{-1}$. If additional hydrogen is present, the hydrogen:feedstock ratio is generally from about 40 to 4,000 $n.l.l^{-1}$ (about 225 to 22,470 SCF/bbl), preferably about 200 to 2,000 $n.l.l^{-1}$ (about 1120 to 11,200 SCF/bbl).

The process may be conducted with the catalyst in a stationary bed, a fixed fluidized bed or with a transport bed, as desired. A simple and therefore preferred configuration is a trickle-bed operation in which the feed is allowed to trickle through a stationary fixed bed, preferably in the presence of hydrogen. With such configuration, it is of considerable importance in order to obtain maximum benefits from this invention to initiate the reaction with fresh catalyst at a relatively low temperature such as 250° C. to 350° C. This temperature is, of course, raised as the catalyst ages, in order to maintain catalytic activity.

Isomerization dewaxing proceeds mainly by isomerization of the n-paraffins to form branched chain products, with but a minor amount of cracking and the products will contain only a relatively small proportion of gas and light ends up to $C_5$. Because of this, it may not be necessary to remove the light ends before sending the isomerized product to the FCC or TCC unit. However, these volatile materials may be removed by distillation, so that only the heavy isomerized product, e.g., the 650° F.+ material, is sent to the FCC or TCC unit.

The selectivity of the isomerization catalyst may be less marked with the heavier oils. With feedstocks containing a relatively higher proportion of the higher boiling materials relatively more cracking will take place and it may therefore be desirable to vary the reaction conditions accordingly, depending both upon the paraffinic content of the feedstock and upon its boiling range, in order to maximize isomerization relative to other and less desired reactions.

Because the isomerized product will be sent to a TCC or FCC, it may not be necessary to achieve significant amounts of hydrocracking. This is because conversion of heavy to lighter materials can be achieved in the FCC or TCC. This may be of advantage because hydrocracking usually consumes a lot of expensive hydrogen, while hydroisomerization, as practiced in the present invention, consumes little or no hydrogen.

A preliminary hydrotreating step to remove nitrogen and sulfur and to saturate aromatics to naphthenes without substantial boiling range conversion will usually improve isomerization catalyst performance, and FCC or TCC performance, and permit lower temperatures, higher space velocities, lower pressures or combinations of these conditions to be employed. The benefits of hydrotreating must be balanced against the capital and operating costs.

The conditions in the isomerization dewaxing reactor can be adjusted so that the primary conversion mechanism of the normal paraffins is isomerization, as opposed to some other reaction such as hydrocracking. Significant benefits can be achieved when only a slight conversion of normal and slightly branched chain paraffins is achieved.

Usually at least 25% conversion of normal paraffins will be achieved, and preferably, 30–90% or more conversion of normal and slightly branched paraffins is achieved.

It may be beneficial to convert less than 50% by weight of the feed to lower boiling products. For refiners that are hydrogen constrained, operation with only the conversion that can be achieved with limited hydrogen consumption, perhaps on the order of 0 to 100 SCFB (0 to 18 n l/l) may be preferred. This limits the amount of expensive hydrogen that must be consumed.

The relative ratio of isomerization to other reactions occurring will in general vary with the feedstock, and particularly with the aromatic content of the feedstock, and the severity of the processing conditions. Significant amounts of hydrocracking may be necessary as the feed gets heavier and more aromatic, and as more dewaxing of feed is required.

SHAPE SELECTIVE CATALYTIC DEWAXING

The preferred shape selective catalytic dewaxing process is disclosed in U.S. Pat. No. 4,446,007, Fritz A. Smith, which is incorporated herein by reference.

Shape selective zeolites, those having a constraint index of about 1–12, are used to selective crack waxy paraffins in the feed. ZSM-5, ZSM-11, ZSM-12, ZSM-23, ZSM-35, ZSM-38, and ZSM-48 are preferred, with ZSM-5 and ZSM-11 being the most preferred.

As disclosed in the patent, rapid increase of the dewaxing reactor temperature, to at least about 360° C. within about the first seven days after start-up, results not only in efficient dewaxing, but also in the production of relatively high octane gasoline as a by-product of the cracking process.

CATALYTIC CRACKING PROCESS CONDITIONS

The catalytic cracking unit used, whether an FCC or TCC unit, can simply be operated in the conventional manner without any changes being made.

Cracking severity may be increased somewhat. This is because fresh feed and/or recycle, which has been subjected to catalytic dewaxing, is easier to catalytically crack, and produces good yields of valuable product even at very high conversions. Conversions of more than 80 percent, by weight, of waxy, difficult to crack stocks can be achieved without excessive coke make, so long as this material has been subjected to extensive catalytic dewaxing.

DETAILED DESCRIPTION OF THE DRAWINGS

In FIG. 1 a fresh feed, usually a heavy, waxy hydrocarbon, enters catalytic dewaxing reactor 3 via line 10. Isomerization dewaxing using zeolite beta (as disclosed in U.S. Pat. No. 4,419,220) or shape selective wax hydrocracking (as disclosed in U.S. Pat. No. 4,446,007) may be used. The product with a reduced wax content is withdrawn via line 31 and charged to distillation column 4 which, in the embodiment shown, provides a relatively light fraction comprising $C_1$–$C_4$ hydrocarbons in line 41, a $C_5$-420° F. naphtha fraction withdrawn via line 42, a distillate fraction withdrawn via line 43 and a relatively heavy fraction, typically a 650° F.+ to 750° F.+ material which is withdrawn via line 44. This heavy material, along with other feed to the FCC, and preferably with any resin fraction added to the unit via line 45 are then charged to conventional FCC unit 1. Preferably FCC unit 1 comprises a riser reactor and catalyst regeneration means, all of which are conventional.

Catalytically cracked product is removed from FCC unit 1 via line 11 and charged to main column 2. The reactor effluent is fractionated into a $C_1$–$C_4$ fraction which is removed via line 21, a naphtha fraction removed via line 22, a distillate fraction removed via line 23 and a heavy fraction, typically a 650° F.+ to 750° F.+ material which is withdrawn via line 24.

The heavy fraction withdrawn from main column 2 via line 24 is a premium quality heavy fuel, and may be removed from the process via line 25. All, or only a portion, of the heavy fuel may be recycled via line 26 back to the dewaxing reactor 3, or recycled via line 51 to the FCC unit.

It is conventional in the FCC arts to refer to the FCC fractionator as the main column, and such usage has been used herein. Distillation column 4, associated with the dewaxing unit 3, may be larger than main column 2. This is because the catalytic dewaxing reactor 3 and its distillation column 4 must process 100% of the relatively light feed in line 10. The waxy feed in line 10 preferably contains most of the wax 350°–800° F. feed, although somewhat heavier fractions may also be present. Only a fraction, usually 30–80%, of the feed in line 10 will eventually be charged to the FCC unit 1. Accordingly the main column 2 may, in an extreme case, be only about half as large as distillation column 4.

Although the embodiment shown in FIG. 1 will achieve the maximum improvement in the crackability of the fresh feed, it would require a large capital investment. This is because catalytic cracking units tend to be fairly large, e.g., 20,000–50,000 bpd. If catalytic dewaxing converts about 20 wt % of the waxy feed in line 10 to a lighter materials, i.e., distillate and lighter materials, than a 62,500 bpd. catalytic dewaxing will be needed to produce 50,000 bpd. of dewaxed feed for the FCC. Many refineries will be constrained by lack of space, or lack of capital, from installing such a large catalytic dewaxing unit. Optimum economic return can usually be achieved when an existing idle unit, such as a hydrotreater, is converted to dewaxing service. This drastically reduces the capital cost of implementing the present invention, but limits the benefits that will be achieved because usually existing, idle refinery units will not be large enough to dewax 100% of the feed to the FCC unit.

In practice, the present invention will be most beneficial in those units where the refinery's throughput is constrained by the catalytic cracking unit. Catalytic dewaxing of a portion of the feed to the catalytic cracking unit will unload the cracker some (by achieving some of the boiling range conversion in the dewaxing reactor) and further improve the operation of the catalytic unit by improving the crackability of the feed (by reducing the normal and slightly branched paraffin content of the feed).

Figure 2:
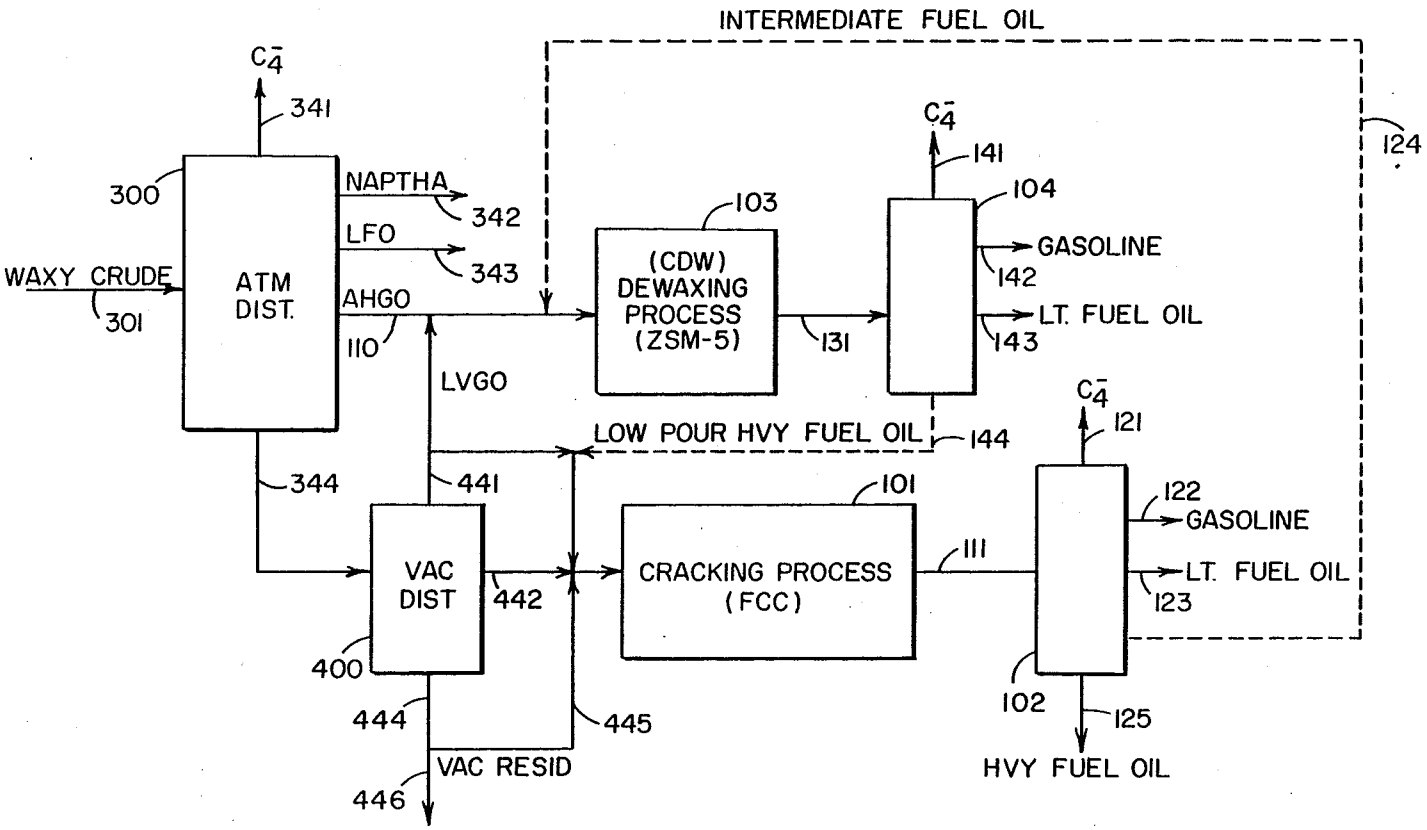
FIG. 2 is a simplified diagram of a preferred way of integrating a catalytic dewaxing unit with an FCC.

FIG. 2 represents a preferred way of intergrating a shape selective catalytic dewaxing process with a catalytic cracking unit.

A heavy waxy crude is charged via line 301 to an atmospheric distillation column 300. $C_4$ and lighter hydrocarbons are removed via line 341, while naphtha and light fuel oil are removed via lines 342 and 343, respectively. An atmospheric heavy gas oil (AHGO) is removed via line 110 while non-distillable material, or atmospheric resid, is removed as a bottoms fraction via line 344. The atmospheric resid is charged to vacuum distillation column 400 which fractionates the resid into a light vacuum gas oil (LVGO) fraction recovered via line 441, a heavy vacuum gas oil (HVGO) fraction recovered via line 442 and a vacuum resid fraction removed as a bottoms product via line 444. The vacuum resid may be either withdrawn as a heavy product via line 446, or a portion of it may be charged via line 445 to the FCC unit 101.

The primary feed to the FCC unit 101 is the heavy vacuum gas oil fraction in line 442. In addition to this, other conventional FCC chargestocks may be added by means not shown, in addition to some of the light vacuum gas oil fraction removed via 441, or even some of the low pour, heavy fuel oil fraction obtained from the catalytic dewaxing process discussed hereafter.

The catalytically cracked hydrocarbons produced by the FCC process are removed via line 111 and charged to the main column 102. $C_4$ and lighter materials are removed via line 191. A gasoline boiling range product is removed via line 122. Light fuel oil is removed via line 123. An intermediate fuel oil, intermediate in boiling range between a light fuel oil and heavy fuel oil, is removed via line 124. A heavy fuel oil product is removed via line 125.

In the catalytic dewaxing process, a majority of the feed comprises atmospheric heavy gas oil derived from the waxy crude. The AHGO is added via line 10, along with intermediate fuel oil from the FCC unit in line 24, and charged to catalytic dewaxing reactor 103. The catalytically dewaxed hydrocarbons are removed via line 131 and charged to fractionator 104. $C_4$ and lighter hydrocarbons are removed via 141. A high octane, low aromatic gasoline fraction is recovered as a product via 142. A light fuel oil product is removed via line 133, while a low pour heavy fuel oil product is removed via line 144 as a product of the process, or is mixed with the vacuum resid to act a cutter stock, or charged to the FCC unit.

Preferably, as shown in the drawing, there is no recycle of either heavy fuel oil or intermediate fuel oil directly to the FCC. The intermediate fuel oil fraction removed via line 124 is a relatively refractory material and is difficult to crack in the FCC. Such materials are relatively aromatic, and frequently contain large amounts of basic nitrogen compounds, which kill the acid activity of the cracking catalyst. Thus, the intermediate fuel oil stream in line 124 represents a material which is both difficult to crack in the FCC and, if recycled to the FCC, degrades the operation of the cracking catalyst, due to the large nitrogen content.

In the present invention, this intermediate fuel oil stream is charged to the catalytic dewaxing reactor 103. The mixture of fresh AHGO and recycled intermediate fuel oil from the FCC provides an ideal feed mixture for the catalytic dewaxing process. The presence of the aromatic, nitrogenous intermediate fuel oil fraction actually upgrades the operation of the catalytic dewaxing reactor, resulting in improved operation thereof as evident by an increase in gasoline octane number, and a decrease in gasoline aromatic content, as compared to operation of the catalytic dewaxing unit without recycle of intermediate fuel oil.

There is also some recycle from the catalytic dewaxing reactor to the FCC unit. The low pour, heavy fuel product of catalytic dewaxing is also ideal as far as pour point, but still has too high a boiling range for any purposes. This feedstock, because of catalytic dewaxing, is now very easily upgraded in the FCC process.

Accordingly, the processing scheme shown in FIG. 2 optimizes both the operation of the FCC process and the catalytic dewaxing process. FCC operation is optimized by eliminating the recycle of refractory, nitrogenous stocks, and by improving the crackability of the feed by removal of normal paraffins therefrom.

The catalytic dewaxing process is optimized by the inclusion of the nitrogenous, aromatic intermediate fuel oil product which is difficult is treat in the FCC unit. The catalytic dewaxing unit achieves the maximum pour point reduction of the heavy feed, while producing large amounts of gasoline having an unexpectedly high octane and an unexpectedly low aromatic content. The dewaxing reactor can be loaded with much heavier charge stocks than are customary for catalytic dewaxing, because the end point of the feed to the catalytic dewaxing unit is no longer a limitation on the end point of the heavy fuel oil product from catalytic dewaxing. The catalytic dewaxing reactor can tolerate much heavier feeds than those permitted by the end boiling point specification of the heavy fuel oil product. These heavier feeds are processed by the catalytic dewaxing unit into catalytically dewaxed, low pour, heavy fuel oil components which are efficiently upgraded to lighter components in the FCC unit. A heavy fuel oil product 125, having the desired end point and pour point specifications, is recovered downstream of the catalytic cracking unit.

Overall optimization is achieved because the FCC unit is relieved from doing those jobs it does inefficiently, namely upgrading nitrogenous and refractory recycle stocks. The FCC unit is called upon only to achieve boiling range conversion, which this process does very well, and especially so when normal paraffins are removed from the feed.

The catalytic dewaxing process efficiently converts wax to high octane gasoline, and is no longer limited by end boiling point restrictions on product. As a bonus, the octane number of the catalytically dewaxed gasoline byproduct is enhanced because of the presence of refractory nitrogenous stocks obtained from the catalytic cracking unit.

EXAMPLES

EXAMPLE 1

This Example describes the preparation of zeolite beta dewaxing catalyst.

A sample of zeolite beta in its as synthesized form and having a silica:alumina ratio of 30:1 was mixed with alumina in a 50/50 weight ratio, and extruded into 1/16" diameter. The extrudate was calcined at 1000° F. (538° C.) in $N_2$ for three hours, then in air for another three hours at the same temperature. The zeolite, in the H-Na form, was then steamed 72 hours at 1000° F., at about 1 atm, absolute, steam pressure.

Platinum was introduced into the ammonium exchanged zeolite beta by conventional ion-exchange of Pt-tetraamine, followed by conventional drying and calcination at about 660° F. in air. The finished catalyst, which contained 0.6 wt % Pt was reduced/presulfided in 2% $H_2S$ in $H_2$ at 700° F. prior to use.

The catalyst was used, in other tests, for 34 days before use in tests representing the present invention. The catalyst was not changed significantly by this other testing.

EXAMPLE 2

Isomerization Dewaxing Conditions

A pilot plant unit was operated at a temperature of 797° F., 400 psig, 1.0 LHSV with 2500 SCFB/$H_2$.

EXAMPLE 3

Catalytic Cracking Catalyst

Durabead 10A equilibrium catalyst obtained from an operating, commercial Thermofor catalytic cracking unit was crushed and sized to 40/80 mesh. About 10 gms of the sized catalyst was diluted with 20–25 gms of equally sized vycor. The mixture was added to a microfluid bed cracking system.

EXAMPLE 4

FCC Conditions

Helium was used for fluidization in the microunit. Helium flow rates were typically 650 cc/min through the 1" ID×3' vycor reactor.

The reaction temperature was held constant at 940° F. and the conversion varied by changing the feed rate to obtain cat./oil ratios (w/w) from 1 to 8. Back pressure on the reaction was 5 psig with the helium carrier accounting for 90–95% of the gas volume. Total cracking time was held constant, at 10 minutes, after which time the feed and helium were shut off. A 40% $O_2/N_2$ flow of 525 cc/min was then introduced to burn off coke on the catalyst. This typically required 15–20 minutes with CO and $CO_2$ levels approaching 10–12% by volume in the off gas. The burn was considered complete when the $CO/CO_2$ levels fell below 0.5%. Typically, 10 cycles of cracking followed by catalyst regeneration were required to obtain enough sample for analysis.

EXAMPLE 5

Charge Stock

The Liquid Feed used in these experiments is a Gippsland 600°–950° F. vacuum gas oil, VGO, characterized by an API gravity of 34.7, 13.6% hydrogen, 0.18% sulfur and 270 ppm nitrogen. This gas oil is extremely waxy, with a pour point of +115° F. and a paraffin content of 50%.

EXAMPLE 6

Isomerization Dewaxing

Isomerization dewaxing of feed at 797° F., 400 psig, 1.0 LHSV and 2500 scf/B $H_2$ flow gave about 87% yield of +10° F. pour point 420° F.+ distillate product. The product was distilled and gave 53% of a +30° F. pour point, 650° F.+ fraction. This fraction was characterized by an API gravity of 27.5, 0.11% sulfur and 390 ppm nitrogen, and was used as charge to the catalytic cracking experiments.

Isomerization dewaxing results in both isomerization and hydrocracking of paraffins in the feed. Product yields obtained at 797° F., 400 psig and 1.0 LHSV, with 2500 SCF/B $H_2$ flow are shown below:

ISOMERIZATION DEWAXING

| | Feed | Product |
|---|---|---|
| $C_1$–$C_4$% wt. (as cut) | — | 2.6 |
| $C_5$-420° F. Naphtha | — | 10.5 |
| 420–650° F. Distillate | 12.0 | 34.3 |
| 650° F.+ | 88.0 | 52.6 |
| $H_2$ Consumption, SCF/B | — | +50 |
| 420° F.+ Pour Point, °F. | +115 | + |

The high temperature, low pressure isomerization dewaxing process consumes very little hydrogen. The low pour point of the 420° F.+ product results from both isomerization and boiling range conversion. The heavy naphtha is of jet fuel quality (JP-4), and the distillate is of premium quality (−5° F. pour, 68 Diesel Index). The gasoline or naphtha fraction would not, however, have the high octane associated with high temperature, shape selective dewaxing.

TABLE 1

| | Gippsland Feed | 650° F.+Product from Isomerization Dewaxing |
|---|---|---|
| API Gravity | 34.7 | 27.5 |
| D 97 Pour Point (°F.) | +115 | +30 |
| KV @ 100° C. | 4.39 | 4.28 |
| % C | 86.17 | 86.91 |
| H | 13.62 | 12.95 |
| S | 0.18 | 0.105 |
| ppm N | 270 | 390 |
| PNA Analysis | | |
| Paraffins | 50.4 | 43.1 |
| Naphthenes | 20.0 | 18.1 |
| Aromatics | 29.6 | 38.1 |
| Simulated Distillation (wt %) | | |
| IBP - 420° F. | 0 | 0 |
| 420–650° F. | 11.9 | 13.50 |
| 650–850° F. | 68.5 | 73.10 |
| 850–1000° F. | 19.4 | 13.30 |
| 1000° F. | 0.2 | 0.10 |

A comparison of the nominal 650° F.+ fraction of the isomerization dewaxing product with the Gippsland Feed indicates that the product is isoparaffinic in nature—i.e., relatively high paraffin concentration and low pour point, with virtually no detectable n-paraffins by GC analysis.

The 650° F.+ product has a lower API gravity and hydrogen content than the feed. There is some desulfurization, but the nitrogen and aromatic contents of the product are somewhat higher. These properties would traditionally indicate that the isomerization dewaxing product should be more difficult to convert by catalytic cracking. However, such highly isoparaffinic compositions as this product have not been studied previously, to our knowledge.

EXAMPLE 7

Catalytic Cracking

Fluid-bed catalytic cracking of the Gippsland feed and the isomerization dewaxing 650° F.+ product was conducted at 940° F. using crushed Durabead 10A Altona TCC equilibrium catalyst at various catalyst/oil ratios. The results indicate that preprocessing of waxy feedstocks by isomerization dewaxing effectively doubles the activity of the cracking catalyst.

Catalytic Cracking of Isom. Dewaxed Product

| Feedstock: | Gippsland Feed | Isom. Dewaxed 650° F.+Product |
|---|---|---|
| Temperature, °F. | 940 | 940 |
| Catalyst/Oil Ratio (w/w) | 7.1 | 3.4 |
| Conversion of 650° F.+% wt. | 63.5 | 58.5 |
| $C_1$–$C_4$% wt. | 4.2 | 4.6 |
| $C_5$-420° F. gasoline | 30.6 | 35.4 |
| 420–650° F. Distillate | 31.0 | 20.9 |
| 650° F.+ | 32.1 | 37.0 |
| Coke | 2.1 | 2.1 |
| 420° F.+ Pour Point, °F. | +100 | +30 |

In addition to the activity gain, the gasoline selectivity obtained is higher for catalytic cracking of the isomerization dewaxed feed. Coke makes appear to be similar for both feeds as a function of conversion.

Analysis of the gasoline fractions indicates that catalytic cracking of the isomerization dewaxed product may result in higher gasoline octane due to a 20% increase in total aromatics+olefins, mainly at the expense of paraffins (we did not have enough sample for an octane measurement, however this could represent a 2–4 RON gain).

| Composition of $C_5$-420° F. Gasoline | | |
|---|---|---|
| Feedstock: | Gippsland Feed | Isomerized 650° F.+Feed |
| Hydrogen, % wt. | 13.8 | 13.6 |
| Paraffins, % wt. | 25.9 | 10.6 |
| Olefins | 49.6 | 72.1 |
| Naphthenes | 7.8 | 3.7 |
| Aromatics | 16.7 | 13.7 |

The 420° F.+ product obtained be cracking of the Gippsland feed remains waxy, while the isomerization dewaxed preprocessed product has a low pour point. Analysis of this fraction indicates that isoparaffins are more effectively converted by the cracking catalyst than the n-paraffins in the Gippsland Feed.

| Composition of 420° F.+FCC Product | | |
|---|---|---|
| Feedstock | Gippsland Feed | Isom. Dewaxed 650° F.+ |
| API Gravity | — | 24.6 |
| Paraffins, % wt. | 54.9 | 39.1 |
| Naphthenes | 12.3 | 13.8 |
| Aromatics | 32.8 | 47.1 |
| Nitrogen, ppm | 200 | 330 |
| Pour Point, °F. | +100 | +30 |

The low pour point of the 420° F.+ product obtained on cracking of the isomerization dewaxed product suggests that more of this product could be used for distillate blending, or as a source of low pour point, low sulfur, heavy fuel oil.

Overall Yields

Overall process yields obtained for isomerization dewaxing followed by catalytic cracking are shown below for the examples discussed in the previous section.

| | Overall Yields | | | | |
|---|---|---|---|---|---|
| | Feed | Isom. | FCC | Overall | Cracking Only |
| $C_1$–$C_4$% wt. | — | 2.6 | 2.4 | 5.0 | 4.2 |
| $C_5$-420° F. | — | 10.5 | 18.6 | 29.1 | 30.6 |
| 420–650° F. | 11.9 | 34.3 | 11.0 | 45.3 | 31.0 |
| 650° F.+ | 88.1 | 52.6 | 19.5 | 19.5 | 32.1 |
| Coke | — | — | 1.1 | 1.1 | 2.1 |
| | 100.00 | 100.0 | 52.6 | 100.0 | 100.0 |

In these examples, the 650° F.+ conversion of feed to the catalytic cracking process is about the same (60%). The combined isomerization-FCC process effectively converts more of the waxy feed to distillate, while maintaining about the same overall yield of light products. Overall conversion of the feed to coke is significantly reduced.

A combination catalytic dewaxing-catalytic cracking process offers the potential for producing both premium gasoline and high quality distillates in high yields, and with greater processing flexibility than could be achieved by either process operating along. Isomerization dewaxing or shape selective catalytic hydrodewaxing preprocessing of the feed or a recycle stream or both could effectively unload the cracking unit, allowing higher overall conversions to be achieved, through a combination of reduction in total feed to the cracking unit and the improved crackability of the isomerized product. In addition, recycle of the unconverted gas oil could be reduced or eliminated because of the low pour point product obtained with isomerization dewaxing preprocessing.

We have estimated product yields at two conversion levels to illustrate the potential of the combined isomerization dewaxing-catalytic cracking (by TCC) Process scheme for processing the waxy Gippsland Feed.

| COMPARISON OF PRODUCT YIELDS | | | | |
|---|---|---|---|---|
| | TCC | ISOM-TCC COMBINATION | | TCC-ISOM |
| TCC Conversion, % | 0 | 60 | 80 | 60 |
| C/O at 940° F. | 7 | 4 | 8 | 7 |
| Dry Gas, % | 2 | 3 | 5 | 3 |
| Alky Feed | 2 | 2 | 4 | 3 |
| Gasoiine + Naphtha | 31 | 21 | 31 | 32 |
| Jet Fuel (JP-4) | — | 8 | 8 | 2 |
| Distillate | 31 | 58 | 47 | 52 |
| Heavy Fuel Oil | 32 | 7 | 3 | 6 |
| Coke | 2 | 1 | 2 | 2 |
| Rel TCC Size | 100 | 25 | 50 | 75 |
| Rel Isom. Size | — | 100 | 100 | 30 |

Catalytic cracking of the Gippsland Feed results in about 33% yield of potential alkylate, catalytic naphtha (reformable after HDT), and gasoline. The 31% yield of distillate is limited by the relatively high concentration of n-paraffins remaining in this product (650° F. endpoint). The low sulfur heavy fuel oil remaining is very waxy, with a pour point in excess of +115° F. A portion of this waxy heavy fuel oil is traditionally recycled but becomes relatively refractory to TCC cracking and results in a significant increase in gas make.

The combined ISOM–TCC process results in higher yields of low pour point distillates at both conversion levels, mainly at the expense of heavy fuel oil and coke. The yield of gasoline can be varied considerably by changing the conversion in the catalytic cracking unit. At the higher conversion level shown (80% 650° F.+ conversion of the Isomerization dewaxed feed), the yield of catalytic naphtha and gasoline is about the same as in the once-through TCC only example, and is produced mainly at the expense of distillate. In addition, a highly paraffinic heavy naphtha is produced by the isomerization dewaxing process, which is suitable for either jet fuel (JP-4) or reforming to gasoline. The endpoint of the distillate product is not restricted by pour point (the yields shown are for 330°–750° F. product). The heavy fuel oil remaining has a low pour point, which may be of some additonal value relative to the waxy TCC only product. The higher overall conversion of the feed obtained with the combined isomerization dewaxing-catalytic cracking process results in more than a 25% increase in the yield of premium products in single pass operation. In addition, less than half of the TCC capacity is required for effectively complete conversion of the original feed and is therefore available for processing additional feed.

SHAPE SELECTIVE DEWAXING-FCC

When shape selective dewaxing, using ZSM-5 catalyst as disclosed in U.S. Pat. No. 4,446,007 (Smith) is used to treat the feed to an FCC unit, similar results will be obtained. The normal paraffins will be removed (by cracking as opposed to isomerization achieved using zeolite beta). The crackability of the feed will be enhanced and the pour point of the heavy fuel oil product of catalytic cracking will be reduced.

Shape selective dewaxing may be practiced exclusively on the feed (which will require relativity large dewaxing unit) or exclusively on a recycle stream to the FCC (which will minimize the size of the dewaxing unit) or some combination of both approaches. Usually optimum economic return will be determined by local conditions at the refinery. Processing of the 10–50% of the FCC feed will usually be sufficient to overcome pour-point problems of heavy fuel oil products from the FCC unit. The benefits of such an operation are illustrated by the next example.

EXAMPLE 8

ZSM-5 Dewaxing Plus FCC

Catalytic dewaxing of a highly paraffinic Minas heavy vacuum gas oil (HVGO) using a ZSM-5 catalyst, as described in U.S. Pat. No. 4,247,388, results in substantial conversion of the feed to gasoline and LPG products. In the following table the results obtained for dewaxing a Minas HVGO, with the properties noted, at 764° F., 880 psig, 1.0 LHSV and about 2000 scf/Bbl hydrogen flow after 54 days on stream are shown:

| Shape-Selective Catalytic Dewaxing | Minas HVGO Feed | Dewaxed Product |
|---|---|---|
| Hydrogen, wt % | — | −0.3 |
| $C_1$–$C_2$ (incl. $H_2S$ | — | 0.7 |
| $C_3^+$ $C_4$, vol. % | — | 23.3 |
| $C_5^+$ Gasoline | — | 39.1 |
| 330° F.+ Fuel Oil | 100.0 | 48.8 |
| $C_5^+$ Gasoline Octanes | | |
| RONC | — | 86 |
| MONC | — | 76 |
| Pour Point, °F. of Fuel | +115 | +55 |
| KV, cs @ 100° C. | 4.43 | 5.60 |
| Distillation, D-2887 | | |
| 10% vol., °F. | 672 | 654 |
| 50 | 797 | 815 |
| 90 | 922 | 967 |

Shape-selective catalytic dewaxing of the Minas HVGO using the ZSM-5 catalyst preferentially promotes cracking of normal and slightly branched paraffins in the feed. The extremely waxy nature of the Minas HVGO feed leads to a fuel oil product of moderate pour point even at about 50% conversion of the feed. The boiling range of the fuel oil which remains is similar to that of the feed, with the cracked products boiling at substantially lower temperatures. Therefore only a small portion could be used for distillate (i.e. No. 2 Fuel Oil) blending while meeting present end point specifictions. The composition of the dewaxed fuel oil product is compared with the feed in the following table:

| Composition of Dewaxed Minas Fuel Oil | Minas HVGO Feed | Dewaxed Fuel Oil |
|---|---|---|
| Hydrogen, wt % | 14.0 | 12.9 |
| Sulfur, wt % | 0.07 | 0.12 |
| Nitrogen, ppmw | 290 | 530 |
| Paraffins, wt % | 56.5 | 19.1 |
| Naphthenes | 25.9 | 47.0 |
| Aromatics | 17.6 | 34.0 |
| Pour Point. °F. | +115 | +55 |

The paraffins remaining in the catalytically dewaxed fuel oil are predominantly isoparaffins, and rings--including heterocyclics are effectively concentrated in this product. While valuable as a low sulfur heavy fuel oil, we realized that the composition of the dewaxed product made it an excellent FCC feed.

EXAMPLE 9

Similarly, lower boiling fractions from a Minas crude were catalytically dewaxed using a ZSM-5 catalyst. The results obtained fro dewaxing a heavy atmospheric gas oil (AHGO) and a light vacuum gas oil (LVGO) are provided in the table below:

| Shape-Selective Catalytic Dewaxing of Minas Gas Oils | AHGO | LVGO | HVGO |
|---|---|---|---|
| $C_1$–$C_4$, wt % | 14 | 19 | 16 |
| $C_5$300° F. Gasoline | 31 | 27 | 33 |
| 330° F. + Distillate/Fuel Oil | 55 | 55 | 51 |
| 330° F.+ Pour Point, °F. | 0 | 0 | 55 |
| Distillation, D-1160 | | | |
| 10 vol %, °F. | 559 | 555 | 662 |
| 50 | 640 | 636 | 780 |
| 90 | 736 | 710 | 922 |

Results are also shown for the HVGO described above. Additional data on the AHGO and LVGO feeds are provided in the examples below. The boiling range ditribution of the dewaxed AHGO and LVGO products indicates that more than half of the low pour point fuel oil boils below 650° F. and could be blended into No. 2 distillate fuel. The remaining bottoms product has a composition similar to the HVGO fuel oil and again would be an excellent FCC feed.

EXAMPLE 10

An FCC unit is used to process a waxy feed derived from Minas crude. A significant component, about 22.5% of the feed, is atmospheric heavy gas oil (AHGO), which is too waxy to blend into the distillate pool. The remaining feed in composed of light and heavy vacuum gas oils (AVGO and HVGO), and some reduced crude. The LVGO is similar in composition to the AHGO. These feed components are difficult to convert in the FCC and are recycled. This intermediate recycle gas oil (ICGO), about 12.5% of the total FCC feed, remains waxy and is similar in composition to the AHGO and LVGO fractions as shown in the table below

| Comparison of Fresh Feed and Recycle | AHGO | LVGO | ICGO |
|---|---|---|---|
| API Gravity @ 60° F. | 38.0 | 35.0 | 29.7 |
| Sulfur, wt % | 0.06 | 0.09 | 0.18 |
| Nitrogen, ppmw | 110 | 240 | 520 |
| Paraffins, wt % | 54.4 | 50.2 | 52.9 |
| Naphthenes (+ olefins) | 19.3 | 18.7 | 10.5 |
| Aromatics | 26.2 | 31.1 | 36.7 |
| Aniline Point, °F. | 189 | 202.5 | 175 |
| Bromine Numbber | 0.4 | 0.6 | 4.9 |
| Molecular Weight | 254 | 299 | 263 |
| KV cs @ 40° C. | 5.18 | 10.29 | 7.39 |
| Pour Point, °F. | 65 | 100 | 85 |
| Distillation, D-1160 | | | |
| 5% , °F. | 463 | 570 | 544 |
| 50% , °F. | 635 | 652 | 683 |
| 95% , °F. | 780 | 734 | 775 |

The cycle oil is cut on the main column of the FCC unit so that a light gas oil fraction of suitable cloud point can be taken for fuel oil blending. Typical FCC product yields are shown in the table below (from J. J. Lipinski and J. R. Wilcox. "Octane Catalyst", *Oil and Gas Journal*, Nov. 24, 1986), for processing a waxy feed containing process streams similar to those described above.

FCC Process Yields With Waxy Feed

| | LCO Mode | Gasoline Mode |
|---|---|---|
| $C_2$ and Lighter, wt % | 2.22 | 2.29 |
| $C_3$ and $C_4$, vol % | 17.6 | 18.8 |
| $C_5$ + gasoline, vol % | 48.8 | 59.8 |
| Light Gas Oil, vol % | 29.8 | 22.5 |
| Decant Oil, vol % | 11.0 | 10.6 |
| Coke, wt % | 3.6 | 4.1 |
| Gasoline RONC | 91.8 | 92.2 |
| Gasoline MDNC | 78.4 | 78.8 |
| Gasoline End Point, °F. ASTM | 350 | 430 |
| LGO End Point, °F. ASTM | about 625 | about 625 |

The end point of the light gas oil product (LGO) is limited by cloud point to about 625° F. as noted above. The need to process the HVGO, LVGO and ICGO fractions coupled with the end point restriction on the LGO product severely limits the FCC unit's capacity for upgrading heavier feeds to gasoline and distillate products. In all, theses waxy gas oils represent nearly half the total feed to the FCC unit.

EXAMPLE 11

Catalytic dewaxing, using a shape-selective catalyst such as the ZSM-5 catalyst described in U.S. Pat. No. 4,247,388, can be used to unload the FCC unit of waxy AHGO. This process combination has been described in U.S. Pat. No. 4,192,734 in a parallel refining scheme designed to maximize distillate yields. The capacity gained is used to allow operation of the FCC unit in the distillate mode with lower conversions to gasoline and higher recycle. Both of these patents are incorporated herein by reference.

However, as noted in the examples above, catalytic dewaxing using shape-selective ZSM-5 catalyst does not substantially reduce the boiling range of the fuel oil product relative to the feed. While catalytic dewaxing can reduce the cloud and pour points of many heavy gas oils to acceptable levels for blending into No. 2 fuel oil, boiling range restrictions may still be applied, and are typically limited to 650°-775° F. end point. In practice, this would limit the boiling range of the feed to the dewaxing unit in the scheme described by U.S. Pat. No. 4,27,388.

EXAMPLE 12

When processing very waxy feeds, such as those derived from Minas, Daching, and/or West African craudes, a novel processing scheme can be applied which integrates shape-selective catalytic dewaxing with FCC to substantially increase gasoline and distillate yields and quality. This scheme is shown in FIG. 2 and is referred to in the following discussion.

The basis for the discussion which follows is assumed to be a 40,000 bbl/sd FCC unit processing a waxy feed similar to that in Example 8, with yields and product properties as noted in Example 10. Prior to the modifications noted, the intermediate fuel oil, or intermediate clarified gas oil, ICGO, is recycled at 5,000 bbl/sd, and the fresh feed rate is 35,000 bbl/sd.

This FCC operation is substantially unloaded by catalytic dewaxing of all the AHGO (9,000 bbl/sd) and a portion of the LVCO (5,000 bbl/sd). An FCC ICGO (now 3,000 bbl/sd) fraction is also diverted to the dewaxing unit (17,000 bbl/sd capacity). The dewaxing products are distilled to separate light gas, gasoline, low pour distillate suitable cloud point for diesel fuel blending, and a heavy gas il bottoms product. The dewaxed bottoms product (4,000 bbl/sd) is combined with the remaining FCC fresh feed. Total fresh feed to the FCC, as additional HVGO and topped crude, and catalytic dewaxing unit (CDW) is effectively increased by 15,000 bbl/sd).

Integrated Process Yields

| | FCC ONLY | FCC | CDW | Total |
|---|---|---|---|---|
| Fresh Feed MB/sd | 35.0 | 36.0 | 14.0 | 50.0 |
| Total Feed, MB/sd | 40.0 | 40.0 | 17.0 | 57.0 |
| AVGO | 9.0 | 0.0 | 9.0 | 9.0 |
| LVGO (part) | — | — | 5.0 | 5.0 |
| LVGO + HVGO + RC | 26.0 | 36.0 | — | 36.0 |
| ICGO | 5.0 | — | 3.0 | 3.0 |
| MDDW BTMS | — | 4.0 | — | 4.0 |
| Liquid Product Yields, MB/sd | | | | |
| $C_3$ + $C_4$ | 6.6 | 7.5 | 4.0 | 11.5 |
| $C_5$ + Gasoline | 20.9 | 23.9 | 6.7 | 30.6 |
| LFO | 7.9 | 9.0 | 4.2 | 13.2 |
| HFO | 3.7 | 1.3 | — | 1.3 |
| Total Liquid Product | 39.1 | 41.7 | 14.9 | 56.6 |
| Volume Gain, % on FF | 111.7 | 115.8 | 106.4 | 113.2 |

FCC of the heavier feed composition, which includes the dewaxed bottoms product, results in increased conversion of heavy fuel oil to gasoline and light fuel oil. Substantially less ICGO is produced. The overall efficiency for processing fresh feed is improved, as indicated by the volumetric gain and utilization of unit capacity.

Integration of shape-selective catalystic dewaxing with FCC in this manner also improves gasoline and distillate quality. The gasoline fraction has a higher octance rating and the light fuel oil meets cloud point specifications with a wider boiling range. Co-processing of the FCC ICGO fraction with the AHFO and LVGO to the dewaxing unit results in a gasoline product octane gain over processing of the straight-run feeds alone.

Gasoline Octanes from Lined-Out Dewaxing Unit

| Feed | Minas HVGO | Minas + ICGO |
|---|---|---|
| Research Octane, RONC | 84-86 | 92-94 |
| Motor Octane, MDNC | 75-77 | 79-81 |
| $C_8$ + Composition, vol % | | |
| Paraffins | 36 | 32 |
| Olefins | 49 | 60 |
| Naphthenes | 10 | 5 |
| Aromatics | 5 | 3 |

The gasoline properties shown in the table were obtained at line-out temeratures in exess of 700° F. in order to achieve high octanes as described in U.S. Pat. No. 4,446,007 (Smith). The synergistic effect of cofeeding the FCC ICGO was unexpected, but may be due in part to the higher nitrogen and aromatic content of this feed component which result in higher operating temperatures required for dewaxing.

This example illustrates the use of shape selective catalytic dewaxing in processing both an FCC fresh feed component and a recycle stream to improve FCC feed quality and product properties. Overall gasoline and distillate yields were substantially increased without increasing the capacity of the FCC unit.

CONCLUSIONS

An integrated catalytic dewaxing and catalytic cracking process offers the potential for producing premium gasoline and high quality distillates in high yields, and with greater processing flexibility than could be achieved by either process operating alone.

Shape selective catalytic hydro-dewaxing, as in FIG. 2, improves the operation of downstream catalytic dewaxing, and produces high octane gasoline as a by-product.

The present invention may also be practiced with other dewaxing processes. Dewaxing processes which may be used to remove the normal and slightly branched chain paraffins from the FCC feed, to produce a feedstock wherein at least a majority of the paraffin content is isoparaffins and a minority is normal paraffins. Processes which may be used to pretreat the FCC or TCC feed, or a recycle stream, include:

(1) shape selective wax cracking using ZSM-5, ZSM-11 and other zeolites with a constraint index of 1 to 12;
(2) normal paraffin extraction using an adsorbent selective for normal paraffins;
(3) solvent dewaxing to remove normal paraffins;
(4) isomerization dewaxing, or any other process that increases the iso-normal paraffin ratio of the feed to a level greater than 1, and preferably to a level in excess of 2 to 5.

The process of the present invention also provides an unusual route to high octane, relatively non-carcinogenic gasoline. The combination of a relatively heavy waxy feed (such as the Minas heavy vacuum gas oil) and a recycled, intermediate boiling range material from the catalytic cracking unit and the catalytic dewaxing process, produces unexpected results. Large gasoline yields are obtained, and the gasolines have an unexpectedly high octane number and an unexpectedly low aromatic content, less than 5.0 vol % aromatics.

It could not have been predicted that adding a high nitrogen and high aromatic material (such as an FCC ICGO) to the feed to a catalytic dewaxing unit would improve the octane number of the product and reduce the aromatcity of the gasoline boiling range material. Nitrogen compounds usually considered a poison for most reactions over acid acting zeolites. Adding aromatic compounds to the feed could hardly be expected to reduce the amount of aromatics in the gasoline boiling range product.

The yields of gasoline which are achievable in the process of the present invention are also unexpectedly high, approaching 50 vol % on a fresh feed basis (6.7 mb/sd per 14.0 mb/sd feed) or 39 vol %, based on combined feed to the catalytic dewaxing unit.

What is claimed is:

1. An integrated process for upgrading a heavy hydrocarbon feed comprising waxy components, and having an end boiling point exceeding 750 F. into lighter products including a heavy fuel oil product by subjecting said feed to both dewaxing and catalytic cracking by:

(a) catalytically dewaxing at least a portion of said feed to produce a dewaxed product with a reduced wax content, and an end boiling point exceeding 750 F. and
(b) catalytically upgrading said dewaxed product by catalytic treatment consisting essentially of catalytic cracking with a conventional catalytic cracking catalyst in a conventional catalytic cracking unit to produce a catalytically cracked product comprising a heavy fuel oil product.

2. Process of claim 1 wherein said catalytic cracking unit comprises a fluidized catalytic cracking unit.

3. Process of claim 1 wherein said catalytic cracking unit comprises a moving bed catalytic cracking unit.

4. Process of claim 1 wherein said dewaxing process comprises contact with a catalyst comprising zeolite beta and a hydrogenation component at a temperature of 200°-540° C., a pressure of atmospheric to 25,000 kPa and a space velocity of 0.1 to 20 hours$^{-1}$.

5. Process of claim 4 wherein said zeolite beta has a structural silica to alumina mole ratio in excess of 30:1 and contains as a hydrogenation component a group VIII noble metal.

6. Process of claim 4 wherein the reaction conditions and catalyst of said dewaxing step are adjusted to achieve dewaxing primarily by hydroisomerization of waxy components.

7. Process of claim 5 wherein the reaction conditions and catalyst of said dewaxing step are adjusted to provide about 30-90% conversion of feed to lighter products.

8. Process of claim 1 wherein said dewaxing process comprises contact with a catalyst comprising a zeolite having a constraint index of about 1-12 at a temperature of 200°-540° C., a pressure of atmospheric to 25,000 kPa and a space velocity of 0.1 to 20 hours.

9. The process of claim 8 wherein said zeolite is ZSM-5.

10. The process of claim 8 wherein the dewaxing process has a start up average reactor temperature of about 200°-310° C., and the average reactor temperature is increased in a uniform manner to at least to 360° C. within about the first seven days of startup of the reactor.

11. Process of claim 1 wherein said dewaxed product of said dewaxing step in distilled to provide a 650° F.+ dewaxed stream which is fed to said catalytic cracking unit.

12. Process of claim 1 wherein at least a portion of said feed to said dewaxing step in a product of said catalytic cracking process.

13. A process for upgrading a heavy waxy feed comprising normal and slightly branched chain paraffins and wherein at least 75 percent of said feed boils at a temperature in excess of 650 F. and the end boiling point of the feed exceeds 750 F. into lighter products including a heavy fuel oil product comprising:

(a) subjecting said heavy feed to catalytic dewaxing over dewaxing catalyst which comprises a zeolite selected from the group consisting of zeolite beta and ZSM-5 having a silica to alumina mole ratio in excess of 10:1 in a reaction zone maintained under reaction conditions including a temperature of 200 to 540 C., a pressure of atmospheric to 25,000 kPa, a space velocity of 0.1 to 20 hours$^{-1}$ and a $H_2$:hydrocarbon ratio of about greater than 0 to about 20 to produce a heavy dewaxed product comprising material boiling above about 650 F. with reduced wax content; and
(b) upgrading said heavy dewaxed product by catalytic treatment consisting essentially of catalytic cracking of said heavy dewaxed product by conventional catalytic cracking at conventional catalytic cracking conditions to produce a heavy fuel oil product.

14. Process of claim 13 wherein said feed has a pour point above about 100° F.

15. Process of claim 13 wherein said catalytic cracking unit comprises a fluidized catalytic cracking unit.

16. Process of claim 13 wherein said dewaxing catalyst comprises zeolite beta having a structural silica to alumina mole ratio in excess of 30:1 and containing a hydrogenation component.

17. Process of claim 16 wherein catalytic dewaxing occurs primarily by hydroisomerization of waxy components.

18. Process of claim 13 wherein said dewaxing catalyst comprises ZSM-5 and catalytic dewaxing occurs primarily by cracking of waxy components.

19. Process of claim 18 wherein the catalytic dewaxing step is conducted at a severity sufficient to produce a heavy dewaxed product with a pour point below 20° F.

20. A process for upgrading a heavy waxy feed having a pour point above about 100 F. into lighter products including a heavy fuel oil product, said feed comprising normal and slightly branched chain paraffins and wherein at least 75% of said feed boils at a temperature in excess of 650 F. and said process comprising:

(a) dewaxing said feed over ZSM-5 having a structural silica to alumina mole ratio in excess of 30:1 in a reaction zone maintained under reaction conditions including a temperature of 200 to 540 C., a pressure of atmospheric to 25,000 kPa, a space velocity of 0.1 to 20 $hr^{-1}$ and in the presence of hydrogen in an amount equal to about 40 to 4000 normal liters per liter to product a heavy product with a pour point of less than 20 F. and a gasoline boiling range product having a research clear octane number of at least 90;

(b) upgrading said heavy product with a pour point of less than 20 F. by a catalytic treatment consisting essentially of catalytic cracking of said heavy product to lighter boiling components in a catalytic cracking unit containing a catalyst comprising a large pore zeolite in an amorphous matrix to produce a heavy fuel oil product.

21. The process of claim 20 wherein the heavy waxy feed contains at least 50 wt % paraffin content.

22. The process of claim 20 wherein the catalytic cracking process produces a catalytically cracked cycle oil boiling above the gasoline boiling range and below the heavy fuel oil range, and wherein at least a portion of said cycle oil product is charged with the heavy waxy feed to the catalytic dewaxing reaction zone, wherein the catalytically cracked cycle oil is present in amount equal to 10–40% of heavy waxy feed and said dewaxing zone produces a gasoline range product having a research clear octane number of at least 91.

* * * * *

UNITED STATES PATENT AND TRADEMARK OFFICE

CERTIFICATE OF CORRECTION

PATENT NO. : 4,944,862

DATED : July 31, 1990

INVENTOR(S) : Nai Y. Chen, et al

It is certified that error appears in the above-identified patent and that said Letters Patent is hereby corrected as shown below:

Col. 7, line 50, should read --thought--

Col. 21, line 48, should read -- Nitrogen compounds are usually considered--

Col. 22, line 42, should read -- step is distilled--

Col. 22, line 46, should read -- step is a product--

Col. 23, line 27, should read -- excess of 650°F and said feed is difficult to crack in a conventional catalytic cracking unit because of its paraffin content, said process--

Signed and Sealed this

Twenty-fourth Day of September, 1991

*Attest:*

HARRY F. MANBECK, JR.

*Attesting Officer*

*Commissioner of Patents and Trademarks*